United States Patent [19]

Tucker

[11] Patent Number: 4,863,774

[45] Date of Patent: Sep. 5, 1989

[54] DRYWALL TAPE WITH PLASTIC BEAD

[76] Inventor: Richard E. Tucker, 8161 La Monte Rd., Anaheim, Calif. 92804

[21] Appl. No.: 146,077

[22] Filed: Jan. 20, 1988

[51] Int. Cl.[4] ..... E04B 2/00

[52] U.S. Cl. ..... 428/77; 428/83; 428/182; 52/417; 52/371

[58] Field of Search ..... 52/366, 371, 417, 418, 52/419, 420, 85, 671, 672; 428/182, 195, 196, 77, 83, 192

[56] References Cited

U.S. PATENT DOCUMENTS

| | | | |
|---|---|---|---|
| T887,014 | 6/1971 | Overbay | 52/417 |
| 1,444,731 | 2/1923 | Clark | 52/672 |
| 2,314,523 | 3/1943 | Speer | 52/417 |
| 2,974,078 | 3/1961 | Petritz | 52/417 |
| 3,091,821 | 6/1963 | Cook, Jr. | 428/195 |
| 3,109,207 | 11/1963 | Cooper | 52/417 |
| 3,345,788 | 10/1967 | Holsman | 52/371 |
| 3,398,494 | 8/1968 | Larson | 52/371 |
| 4,378,394 | 3/1983 | Minra | 428/182 |
| 4,496,617 | 1/1985 | Parker | 428/195 |

FOREIGN PATENT DOCUMENTS

| | | | |
|---|---|---|---|
| 520145 | 6/1953 | Belgium | 428/182 |
| 1331354 | 9/1973 | United Kingdom | 428/182 |

*Primary Examiner*—Henry E. Raduazo

[57] ABSTRACT

An improved drywall tape is comprised of an elongated ribbon of porous paper tranversely corrugated throughout its length and having a fexible, elongated plastic bead secured to the ribbon of paper and extending longitudinally along the length of the paper. The plastic bead provides a distinct, protected corner to finished drywall, and the corrugations in the tape strengthen the tape to make it stiffer and harder when it dries and easier to work with during installation.

2 Claims, 2 Drawing Sheets

DRYWALL TAPE WITH PLASTIC BEAD

BACKGROUND OF THE INVENTION

1. Field of the Invention

The present invention relates to an improvement in tape for use in covering joints and corners of interior building walls constructed of wallboard panels or sheets.

2. Description of the Prior Art

In current building construction techniques, sheets of drywall, which are sometimes called wallboard, are widely used to form the surfaces of interior walls of residential, commercial and industrial buildings. Drywall has widely replaced plaster as the standard interior building wall fabrication material due to the speed and ease with which it can be installed. Drywall, or wallboard, is formed of sheets of plaster which are sheathed in an outer wrapping of heavy construction paper. Large sheets of drywall are typically provided at the construction site in sizes of four feet by eight feet or four feet by twelve feet. The drywall sheets are sometimes installed intact, but it is usually necessary to cut them to size to form interior building walls.

Drywall tape is widely used in the building construction industry as a means for covering the crevices between abutting panels of drywall. Conventional drywall tape is provided in narrow, elongated ribbons or strips of porous paper wound into rolls. The paper is sometimes perforated to increase moisture penetration and to prevent air bubbles from being entrapped behind the tape. The drywall tape is first applied to joints and edges of abutting drywall panels and is then covered with wet plaster, sometimes called "mud". The plaster is feathered and smoothed along the edges of the tape to conceal the demarcations between the tape edges and the drywall panels to which the tape is applied. When the wet plaster has dried the tape and the drywall can be painted or otherwise covered with a suitable wall covering. Because drywall tape is formed of paper it is quite flexible and will conform to various surface configurations of the edges of intersecting panels of drywall.

While the edges, as well as the flat, expansive surfaces of sheets of drywall are originally covered with heavy paper, the edges of encapsulated sheets of plaster therewithin are exposed where the sheets of drywall are cut to size. When the severed edges of the drywall sheets are exposed, the exposed plaster does tend to crumble unless the severed edges are somehow protected. This is especially important at exterior wall corners.

When conventional drywall tape is used at the exterior corners of walls, however, the flexibility of the tape often results in a corner demarcation which is irregular, since the tape does conform to irregularities in the exposed, severed edges of the drywall panels. As a consequence, conventional drywall tape is often not used at exposed exterior corners. Such exterior corners define doorway openings, in contradistinction to interior corners, such as are formed by intersecting drywall panels in the corner of a room, for example. That is, exterior corners are those corners in which the building walls encompass an angle of less than 180 degrees, while in an interior corner the building walls encompass a reflex angle.

To finish the exterior corners in building construction, metal corner beads are often employed. Conventional metal beads are configured in an L-shaped or angle-shaped cross section and are typically fabricated from elongated perforated strips of metal, such as galvanized steel, permanently deformed with a lengthwise 90 degree bend to form elongated angles. The metal beading is typically positioned at the intersections of adjacent drywall panels which meet at right angles to form an exterior corner within a room. The sections of metal beading are nailed in place through the drywall panels to wooden supporting structural members located behind the drywall panels. Wet plaster is then smoothed into place to cover the metal flange or leg members of the metal beading, and the edges of the plaster are smoothed and feathered to attempt to conceal the metal edges.

While the rigidity of the metal beading does allow an exterior corner of an interior building wall to be finished with a sharp, straight edge, which is aesthetically pleasing, the use of metal beading involves several significant problems. Specifically, since the adjacent angle flanges of the metal beading are rigid so as to preserve the straight, linear configuration of the apex of the beading, the metal beading will only conform to straight, linear edges formed by orthogonal sections of drywall panels. The metal beading will not conform to drywall edges which are cut in an arcuate form to form, for example, an arched doorway. Also, the flanges of the metal beading are significantly stiffer than drywall tape, and do not always readily lay flat against the surfaces of the drywall. Consequently, the flanges of the metal beading can be concealed only with the application of a considerably greater amount of wet plaster, as compared with the amount of wet plaster required to conceal conventional drywall tape. This results in both an increased material cost, as well a substantially increased labor cost. Moreover, at locations where the flanges of the metal corner bead do not reside in intimate contact with the drywall surface, the dried plaster between the flanges of the metal bead and the drywall will tend to crumble, particularly if any pressure is exerted on the flanges of the metal corner bead. Furthermore, over a period of time the metal corner bead will rust, thereby producing rust stains which are clearly visible on the surfaces of the walls at the corner.

SUMMARY OF THE INVENTION

In one broad aspect the present invention is a drywall tape comprising an elongated ribbon of porous backing material and a flexible elongated plastic bead secured to the ribbon and extending longitudinally along the length of the ribbon. Preferably, the ribbon is transversely corrugated throughout its length.

By providing drywall tape with a ribbon or strip of porous flexible backing material, such as paper, which is tranversely corrugated throughout its length, the strength of the tape is increased by approximately a factor of ten as contrasted with conventional drywall tape formed only of the same backing material. The corrugations add hardness and stiffness to the finished surface when the wet plaster applied thereto dries, yet the corrugations in the ribbon allow the drywall tape to be contoured and configured over curved, exterior corners of intersecting drywall panels with far greater facility than is possible with conventional drywall tape. The drywall tape of the invention may also be readily applied to exterior corners having angles other than ninety degrees, as well as the more typical ninety degree angles which are found in building construction. The corrugated tape of the invention is especially advantageous for finishing exterior corners of curved archways, since the corrugations will spread and contract somewhat to allow the tape to conform to such curved edges.

The flexible elongated plastic bead which is secured to the ribbon may be formed of acrylic, styrene, or polyvinyl chloride plastic, as well as other flexible plastic materials. The plastic bead provides a clean, sharp demarcation between intersecting drywall panels, and tends to conceal irregularities in the cuts of exposed, intersecting edges of the drywall panels. Due to the resiliency of the plastic of which the bead is formed, chipping of the dried finishing plaster that is feathered from the edge of the tape to the bead is avoided. This is because the bead forms a protective bullwork against which the plaster is retained where exposure to incidental contact is greatest.

One embodiment of the improved drywall tape of the invention may be constructed with a bead that is formed of an elongated length of a sector of plastic tubing having an arcuate cross sectional configuration. The tubing sector is tranversely centered within the strip of backing material and has an exposed convex surface and a concave surface which is secured to the strip of backing material. By forming the bead from such an arcuate sector of cylindrical annular plastic tubing, a "bullnose" corner is produced. Typically, the interior diameter of the tubing may be about five-eighths of an inch, although the size will vary depending upon the corner configuration desired. Tubing of between one-fourth and one inch in inner diameter may be cut lengthwise into arcuate sectors for use as beading according to this embodiment of the invention.

Another feature of another preferred embodiment of the invention is the provision of an intermediate strip of porous, uncorrugated paper which is wider than the corrugated ribbon of backing material and which is interposed between the plastic bead and the corrugated ribbon. The bead and the ribbon are secured to opposite surfaces of the intermediate strip. For example, the intermediate strip may be four inches in width while the corrugated ribbon may be two inches in width. The inner, corrugated surface of the corrugated ribbon or strip is disposed in contact with the drywall surfaces and provides increased strength to the tape immediately adjacent to the plastic beading, when the plastic beading is tranversely centered relative to the corrugated and uncorrugated strips. The extreme outer edges of the uncorrugated, intermediate strip of backing material may be feathered more easily with wet plaster so as to conceal the edges of the tape with less plaster and with less labor than would be required to conceal the corrugated ribbon alone.

The improved tape of the invention has a very significant functional advantage as contrasted with conventional metal corner beading. For example, it is oftentimes necessary to cover and reinforce a curved edge at an exterior corner formed by intersecting wallboard panels. Such edges are present in all arched doorways. When conventional metal corner beading is employed, the metal flanges of the beading must be cut laterally at numerous intervals to prevent buckling. Such a repetitious cutting operation is labor intensive, time consuming and expensive. With the improved beading of the present invention, however, the corrugated portions of the backing paper allow a certain amount of expansion and overlap without producing any noticeable buckling once the wet plaster is applied. Furthermore, any lateral tearing of the edge of the backing material toward the bead may be performed quickly and easily by hand, so that no time is expended in manipulating a tool to make any lateral cuts for this purpose. Also, the improved tape of the invention is far cheaper than conventional metal beading. Furthermore, the improved tape of the invention produces no rust stains, in contrast to conventional metal corner beading.

One primary object of the present invention is to provide a protective drywall tape for exterior corners of intersecting drywall panels which is particularly suitable for curved edges formed by intersecting wallboard panels.

Another important object of the invention is to provide an improved drywall tape which will readily conform to a variety of different edge configurations of intersecting drywall panels, but which will not conform to irregularities in the severed edges thereof, and will instead provide a smooth, clearly delineated corner.

Another important object of the invention is to provide a drywall tape which employs a bead and which is relative inexpensive to produce.

Further objects and advantages of the improved drywall tape of the invention will become apparent from the description of specific embodiments of the invention which are depicted and described in the drawings.

DESCRIPTION OF THE EMBODIMENTS

Figure 1:
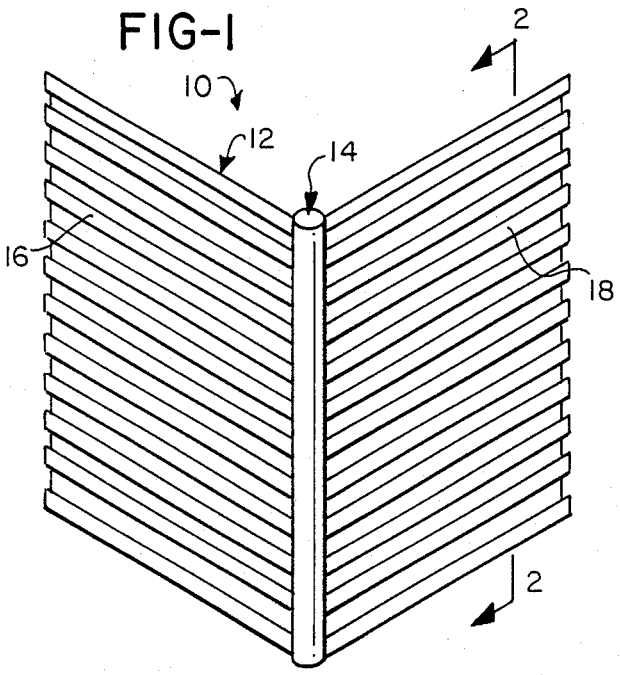
FIG. 1 is a perspective view of a section of one preferred embodiment of the improved drywall tape of the invention.
Figure 2:
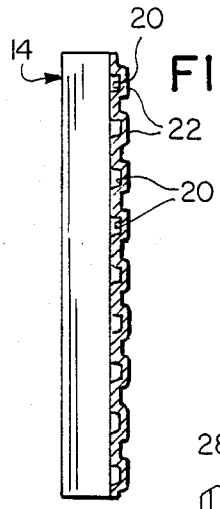
FIG. 2 is a sectional elevational view taken along the lines 2—2 of FIG. 1.

FIG. 1 illustrates a section of improved drywall tape 10 according to the invention as viewed from the exterior exposed surface thereof in which the drywall tape 10 is folded tranversely into an L-shaped or angle-shaped configuration for application to an exposed corner formed by two panels of drywall which intersect each other perpendicularly at their edges. The drywall tape 10 is comprised of an elongated strip 12 of porous, flexible backing material, such as paper, and a narrow bead 14 of plastic of cylindrical configuration and circular cross section centered within the strip 12 of backing material to form opposite side margins 16 and 18 on opposite sides of the bead 14. The bead 14 is secured to the strip 12 by glue. The bead 14 extends linearly throughout the length of the strip 12 of backing material. The backing material 12 is corrugated tranversely throughout its length, as depicted in FIG. 2 to form a series of alternating furrows 20 and ridges 22, as considered from a vantage point external to the corner to which the tape 10 is to be applied. The alternating furrows 20 and ridges 22 provide the extreme peripheral edges of the side margins 16 and 18 with folds which may be extended and contracted in accordion-like fashion to allow the side margins 16 and 18 to conform to a variety of corner configurations of intersecting drywall panels.

Figure 3:
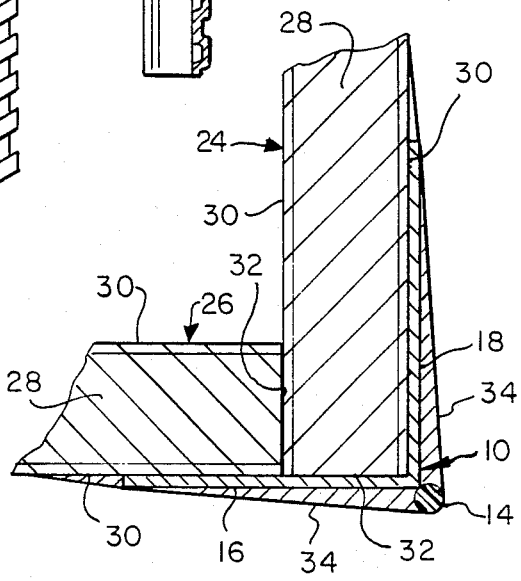
FIG. 3 is a sectional plan view of the improved drywall tape of FIG. 1 applied to intersecting panels of drywall at an exterior corner.

FIG. 3 illustrates in cross sectional plan view the manner of application of the drywall tape 10 to an exterior corner formed by intersecting drywall panels 24 and 26. As illustrated in FIG. 3 the drywall panels 24 and 26 are both constructed of pressed plaster center cores 28 which extend in sheets and have opposing flat, expansive faces covered by construction paper layers 30. The paper layers 30 confine the plaster core sheets 28 therebetween. However, as is typically the case, the tranverse edges 32 of the panels 24 and 26 must be severed, and are left without any paper layer 30 thereon.

To utilize the improved drywall tape 10 of the invention, the side margin 16 of the drywall tape 10 is pressed against the unprotected edge 32 of the panel 24 and against the periphery of the outer surface of the panel 26 which is protected by an outer paper layer 30. The side margin 18 of the drywall tape 10 resides in intimate contact throughout with the peripheral portion of the outer surface of the drywall panel 24 that is covered with an outer paper layer 30. The drywall tape 10 is held in position on the exterior corner formed by the intersecting drywall panels 24 and 26 by wet plaster 34, which is spread upon the side margins 16 and 18 so as to permeate the material of the backing strip 12. While wet, the plaster 34 is feathered at the extreme outer edges of the side margins 16 and 18 so as to smoothly blend in with the outer surfaces of the drywall panels 24 and 26. The plaster 34 is thickest immediately adjacent to the plastic bead 14.

As illustrated in FIG. 3 it can be seen that the plaster 34 resides in abutment against opposite sides of the corner bead 14, which provides a firm protective bullwork for the plaster and which serves to prevent the plaster 34 from being exposed at the corner apex. Such exposure would typically lead to crumbling of the plaster 34 over time.

Figure 4:
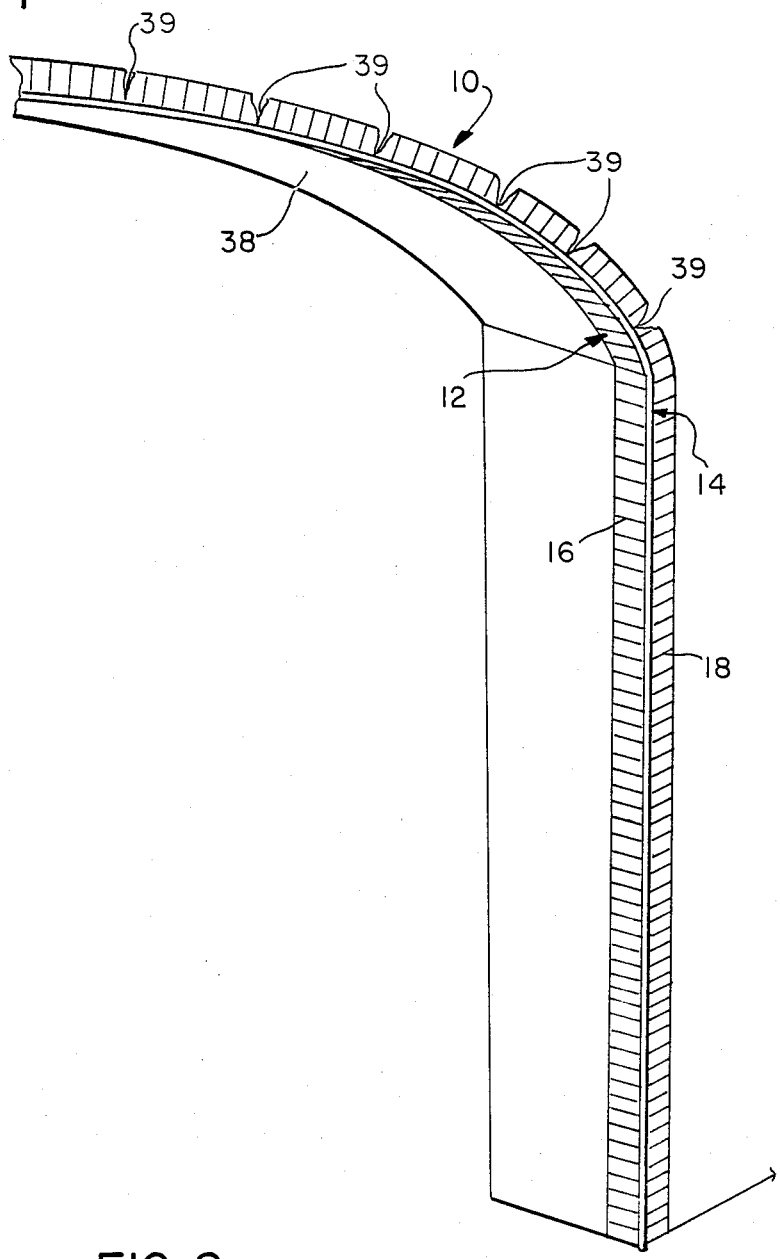
FIG. 4 is a perspective view illustrating the application of the embodiment of FIG. 1 to a doorway having a curved arch.

FIG. 4 illustrates in perspective the particularly advantageous application of the drywall tape 10 to curved exterior corners, such as the overhead archway 38, prior to the application of the surface blending plaster 34. As illustrated in FIG. 4 the flexible nature of both the backing material 12 and the plastic bead 14 allows the drywall tape 10 to conform to the curvature of the archway 38 to a far greater extent than conventional metal beading. The corrugations formed by the alternating furrows 20 and ridges 22 expand and contract, to a limited degree, to allow the edges of the side margins 16 and 18 to be extended so as to conform to the curvature of the archway 38. Even with the corrugations it is necessary for the side margin 18 to be torn periodically as indicated at 39 to allow the improved drywall tape 10 to completely conform to the configuration of the archway 38. Nevertheless, the intervals at which lateral tears 39 must occur are spaced considerably further apart than would be the case with conventional metal beading. Moreover, the tranverse tears 39 may be easily created manually by the drywall and plaster installer's fingers.

Figure 5:
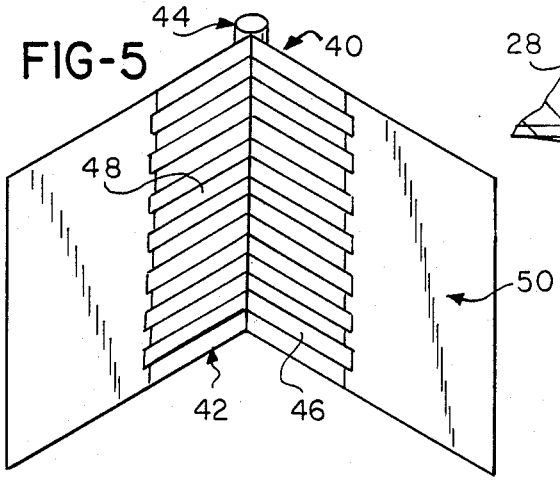
FIG. 5 is a perspective view of an alternative embodiment of the invention.

FIG. 5 illustrates in perspective a section of an alternative embodiment of drywall tape 40 according to the invention, as viewed from the back side and from the vantage point of an exterior corner to which the tape 40 is to be applied. As illustrated in FIG. 5 the drywall tape 40, like the drywall tape 10, is formed of a first elongated strip 42 of porous, flexible backing material, such as paper, and from a bead 44 of plastic centered within the strip 42 and extending linearly throughout its length. As with the tape 10, the backing strip 42 of the tape 40 is transversely corrugated throughout and has side margins 16 and 18 on opposite sides of the plastic bead 14. However, the drywall tape 40 also is comprised of a second, intermediate strip 50 of porous, uncorrugated paper which is wider than the corrugated strip of ribbon 42. The uncorrugated strip 50 is interposed between the plastic bead 14 and the corrugated ribbon 42 so that the bead 44 and the ribbon 42 are secured by glue to opposite surfaces of the intermediate strip 50. The inner, corrugated strip 42 provides the tape 40 with considerably increased strength and renders the tape 40 stiffer and harder once the plaster applied thereto dries. Nevertheless, the corrugations of the ribbon 42 render the tape 40 easier to work with during the installation process.

Figure 6:
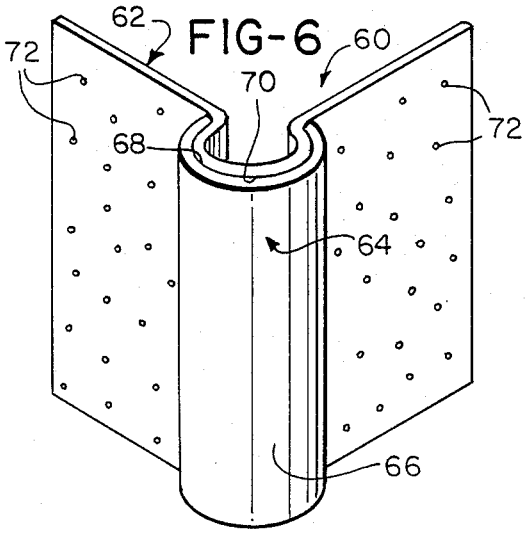
FIG. 6 is a perspective view of yet another alternative embodiment of the invention.

FIG. 6 illustrates another embodiment 60 of drywall tape according to the invention as viewed from a location looking toward an exterior corner to which the drywall tape 60 is to be applied. The drywall tape 60 is comprised of an elongated strip 62 of porous, flexible backing material and an elongated length of a sector of plastic tubing 64 having an arcuate cross sectional configuration. The sector of tubing 64 is transversely centered within the backing material 62. The tubing sector 64 has an exposed convex surface 66 and a concave surface 68 which is secured to the strip of backing material 62 by means of glue applied along the length of the interface between the concave surface 68 and the convex surface 70 of the backing strip 62. The center of the backing strip 62 is pressed into the concave, arcuate channel formed by the surface 68 of the plastic bead 64 so that the plastic bead 64 is firmly secured to the backing strip 62. The side margins of the backing strip 62 are perforated by apertures 72. The apertures 72 prevent air from becoming entrapped between the drywall panels and the backing strip 62 and enhance the extent to which the wet plaster penetrates and bonds the backing strip 62 to the surfaces of drywall panels therebehind.

Figure 7:
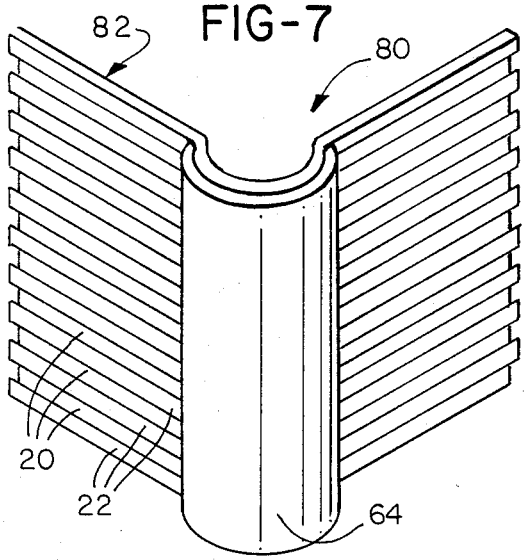
FIG. 7 is a perspective view of still another alternative embodiment of the invention.

FIG. 7 illustrates another embodiment of a drywall tape 80 formed according to the invention which is similar in many respects to the drywall tape 60. Specifically, the drywall tape 80 has a bead 64 formed by a length of a sector of plastic tubing having an arcuate configuration. The drywall tape 80 is otherwise identical to the drywall tape 60 with the exception that the elongated backing strip 82 is transversely corrugated throughout its length to define alternating furrows 20 and ridges 22. The drywall tape 80 has all of the advantages hereinbefore described in connection with the other embodiments of corrugated drywall tapes illustrated.

Figure 8:
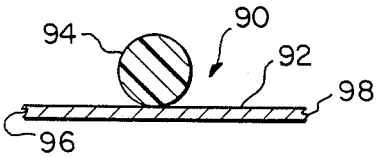
FIG. 8 is a cross sectional view of an embodiment of the drywall tape of the invention having a plastic bead of circular cross section.

The configuration of the plastic bead may have numerous variations. FIG. 8 illustrates in cross section a drywall tape 90 in which the plastic bead 94 is of cylindrical configuration and has a circular cross section. The plastic bead 94 is secured by adhesive to an elongated ribbon 92 of backing material. The ribbon 92 is formed with opposing parallel longitudinal edges 96 and 98 and the plastic bead 94 is centered between the longitudinal edges 96 and 98 and extends longitudinally parallel thereto.

Figure 9:
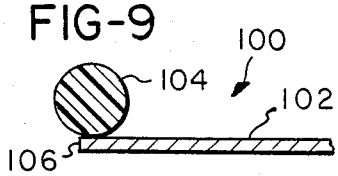
FIG. 9 is a sectional view of an embodiment of the drywall tape of the invention having a circular cross section and positioned at one edge of a strip of backing material.

FIG. 9 illustrates a drywall tape 100 wherein a plastic bead 104 is secured to an elongated ribbon 102 along one longitudinal edge 106 thereof. The drywall tape 100 would typically be used adjacent to a molding or a doorjamb or another structure having an exterior surface likely to require scraping to remove joint cement or other materials therefrom. The scraping of such a surface would be likely to damage the adjacent corner of a drywall panel abutting thereagainst without some protection. The bead 104 and the ribbon strip edge 106 are preferably disposed in abutment against such a molding to enhance the protection provided to the drywall panel therebehind.

Figure 10:
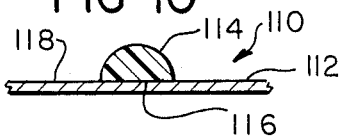
FIG. 10 is a cross sectional view of an embodiment of the drywall tape of the invention having a plastic bead of semicircular cross section.

FIG. 10 illustrates another drywall tape 110 wherein the bead 114 thereof is of semicircular cross section throughout and is secured by adhesive to a backing paper ribbon 112. The flat surface 116 of the bead 114 is secured directly against the outer, exposed surface 118 of the backing strip 112.

Figure 11:
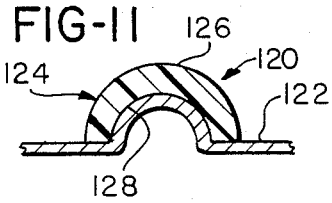
FIG. 11 is a cross sectional view of an embodiment of the drywall tape of the invention having a plastic bead formed as a sector of plastic tubing having an arcuate cross sectional configuration.

FIG. 11 illustrates another drywall tape 120 wherein the plastic bead 124 is of semicircular, arcuate cross section and has an exposed convex surface 126 and a concave surface 128 secured to the porous backing strip 122 by adhesive. The center of the backing strip 122 is pressed into the concave channel defined by the bead 124 to enhance bonding between the plastic bead 124 and the backing strip 122.

Figure 12:
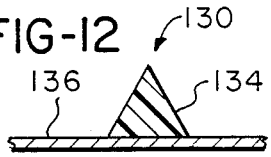
FIG. 12 is a cross sectional view of an embodiment of the drywall tape of the invention having a plastic bead of triangular cross section.

FIG. 12 illustrates a drywall tape 130 in which the plastic bead 134 is of triangular cross section throughout. The bead 134 is secured along one flat side to an elongated strip 136 by means of adhesive.

All of the embodiments of the drywall tape of the invention illustrated are constructed in a continuously running process in which the elongated backing strip is unrolled from a reel and fed along a continuous path. The backing material of the tape is directed through a pair of corrugating rollers which continuously impress the backing material with alternating furrows and ridges. The backing material is then passed to an adhesive applicating means which continuously applies adhesive to one side of the strip. In those embodiments of the drywall tape of the invention in which the plastic bead is to be located parallel to and between the two parallel edges of the elongated ribbon, the backing ribbon is creased longitudinally into a V-shaped configuration in which the side margins intersect at an angle. The plastic bead material is fed from a spool onto the adhesive coated portion of the backing material, and the bead and the backing material are passed between compressing rollers which firmly force the bead onto the backing material to ensure a proper bond of the bead to the backing material by means of the adhesive. The drywall tape is then rewound onto a spool or drum for storage and subsequent use.

Undoubtedly, numerous variations and modifications of the invention will become readily apparent to those familiar with drywall construction and drywall construction materials and accessories. Accordingly, the scope of the invention should not be construed as limited to the specific embodiments of the invention depicted and described, but rather is defined in the claims appended hereto.

I claim:

1. A dry wall tape comprising an elongated strip of porous, flexible backing material corrugated transversely throughout its length and a bead of plastic of semi-circular cross section having a flat surface centered within said strip of backing material and secured directly against said elongated strip by adhesive and extending linearly throughout the length of said backing material.

2. A dry wall tape comprising an elongated strip of porous, flexible backing material corrugated transversely throughout its length and a bead of plastic of arcuate cross section having an exposed convex surface and having a concave surface centered within and secured to said strip of porous backing material by adhesive and extending linearly throughout the length of said backing material.

* * * * *